US005402542A

United States Patent [19]

Viard

[11] Patent Number: 5,402,542

[45] Date of Patent: Apr. 4, 1995

[54] FLUIDIZED PATIENT SUPPORT WITH IMPROVED TEMPERATURE CONTROL

[75] Inventor: Jean-Louis Viard, Montpellier, France

[73] Assignee: SSI Medical Services, Inc., Charleston, S.C.

[21] Appl. No.: 51,468

[22] Filed: Apr. 22, 1993

[51] Int. Cl.[6] ..... A61G 7/00

[52] U.S. Cl. ..... 5/421; 5/453; 5/912; 62/95; 62/261

[58] Field of Search ..... 5/421, 423, 453, 912; 62/95, 261, 299

[56] References Cited

U.S. PATENT DOCUMENTS

| | | | |
|---|---|---|---|
| 1,817,277 | 8/1931 | Uhlig . | |
| 2,146,483 | 2/1939 | Philipp | 62/95 |
| 2,726,658 | 12/1955 | Chessey | 62/261 X |
| 3,521,460 | 7/1970 | Knowles | 62/95 |
| 4,175,297 | 11/1979 | Robbins et al. . | |
| 4,564,965 | 1/1986 | Goodwin . | |
| 4,609,854 | 9/1986 | Yamamoto et al. . | |
| 4,637,083 | 1/1987 | Goodwin . | |
| 4,642,825 | 2/1987 | Kurita | 5/912 |
| 4,723,328 | 2/1988 | Kato . | |
| 4,835,802 | 6/1989 | Purcey et al. | 5/912 X |
| 4,907,308 | 3/1990 | Leininger et al. . | |
| 4,959,013 | 9/1990 | Reynolds | 62/299 X |
| 5,008,965 | 4/1991 | Vrzalik | 5/912 X |
| 5,016,304 | 5/1991 | Ryhiner . | |

FOREIGN PATENT DOCUMENTS

| | | |
|---|---|---|
| 0317009 | 5/1989 | European Pat. Off. . |
| 0332242 | 9/1989 | European Pat. Off. . |
| 2546403 | 5/1984 | France . |
| 58-94852 | 6/1983 | Japan . |
| 61-22860 | 1/1986 | Japan . |
| 61-103122 | 7/1986 | Japan . |
| WO9000381 | 1/1990 | WIPO . |

*Primary Examiner*—Michael F. Trettel
*Attorney, Agent, or Firm*—Dority & Manning

[57] ABSTRACT

A fluidized bed includes an air blower, a heater, an air/air heat exchanger with auxiliary fans, and an air/-cold water heat exchanger. The fluidized bed includes a remotely disposed portable water chiller that provides the cold water for circulating in the air/cold water heat exchanger. The water chiller includes a water refrigeration unit and a water pump. Flexible tubing carries cooled water from the water chiller to the air/cold water heat exchanger and relatively warmed water from the air/cold water heat exchanger to the water chiller. Each of the free ends of the tubing, the water chiller, and the air/cold water heat exchanger, is provided with mating male or female connectors to enable the tubing to be selectively connected and disconnected between the water chiller and the air/water heat exchanger. A programmable EPROM uses temperature information from temperature sensors and the operating characteristics of the heater, air/air heat exchanger, fans, air/water heat exchanger, and water chiller to control the operation of the heater, the fans, and the water chiller for optimum efficiency in maintaining a desired temperature of the patient support surface under the extant temperature conditions in the environment of the fluidized bed.

18 Claims, 4 Drawing Sheets

FLUIDIZED PATIENT SUPPORT WITH IMPROVED TEMPERATURE CONTROL

BACKGROUND OF THE INVENTION

The present invention relates to systems that support a patient on a support surface defined by granular material that has been fluidized with pressurized air passing through the granular material and more particularly to such systems having improved control over the temperature of the patient support surface.

Typically, the air used to fluidize the granular material of a fluidized patient support system such as shown in U.S. Pat. No. 4,564,965 (which is hereby incorporated herein by this reference), is pressurized by an air blower. When the ambient air has passed through the blower, the temperature of the air has been increased by about 20° C. or more. As this air impinges upon the patient supported on the fluidized support surface, the temperature of this air becomes a concern for patient care and comfort.

In U.S. Pat. No. 4,637,083, which is hereby incorporated herein by this reference, a fluidized patient support apparatus deploys a heat exchanger 54 between the fluid pressure generator means 50 and a common fluid pressure manifold 29, which carries the air that fluidizes the granular material 40 carried in the tank 15.

In U.S. Pat. No. 5,016,304, which is hereby incorporated herein by this reference, an air drying unit 8 is interposed in the path of the air between the blower and the plenum chamber beneath the beads of a fluidized bed. Cooling of the fluidizing air takes place in the air treatment chamber 8, and this condenses moisture from the air in chamber 8 such that dry air arrives in the fluidization chamber 2 via a duct 4 and the distribution space 3 and can return to the surrounding atmosphere via the lying surface 1*a*. The evaporating means 7 located in air treatment chamber 8, is part of a cooling circuit which consists of a compressor 12 and a condenser 13. Compressor 12 regulates transportation of a coolant such as freon via the connecting lines in the direction of arrow $P_2$ along the previously mentioned evaporating means 7. However, the use of freon gas in the hospital environment is to be avoided in general and in particular in a fluidized bed so that an accidental leakage of freon cannot become mixed with fluidization air.

In U.S. Pat. No. 4,609,854, which is hereby incorporated herein by this reference, a fluidized bed is provided with a cooler 7 to cool air that is supplied to a tank 2 containing the beads of a fluidized bed. A sensor S1 is provided in tank 2 to detect the temperature of the beads. A fan motor FM circulates air around the cooling fins of cooler 7 so that cooled, compressed air causes the beads to move around in tank 2.

In U.S. Pat. No. 4,723,328, which is hereby incorporated herein by this reference, a fluidized bed includes a radiator 11 in a conduit 10, which couples an air blower to the plenum chamber so that the blower can supply compressed air to the plenum chamber.

OBJECTS AND SUMMARY OF THE INVENTION

It is a principal object of the present invention to provide a fluidized patient support system having an improved apparatus for regulating the temperature of the support surface.

Another principal object of the present invention is to provide an improved apparatus that balances the capabilities of the heating and cooling devices of the fluidized patient support system against ambient temperature conditions and the operator's desired temperature of the beads of the patient support surface, to attain and maintain the desired temperature for the support surface of the patient support system in an efficient manner.

Yet another principal object of the present invention is to provide an improved apparatus that regulates the desired temperature of the support surface of a fluidized patient support system in successive stages that are selectively operable for improved operating efficiency according to monitored temperature conditions in the environment of the patient support surface..

Still another principal object of the present invention is to regulate the temperature of the support surface of a fluidized patient support system using a cooling device that minimizes the heat created in the room containing the fluidized patient support system.

It is a further principal object of the present invention to provide an improved apparatus that regulates the temperature of the support surface of a fluidized patient support system while eliminating the danger of introducing freon gas into the patient support surface.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a fluidized bed includes an air blower to provide pressurized air for fluidizing the beads, an air/air heat exchanger with auxiliary fans, and an air/-cold water heat exchanger. The air/air heat exchanger with the auxiliary fans is configured and disposed to encounter the flow of air exiting the blower and is disposed between the blower's outlet and the air/cold water heat exchanger.

In addition, the fluidized of the invention includes a heater and a remotely disposed portable water chiller that provides the cold water for circulating in the air/-cold water heat exchanger. The water chiller includes a water refrigeration unit and a water pump. A water pressure reducer is configured and disposed with respect to the air/cold water heat exchanger to prevent leakage of the water introduced into the air/cold water heat exchanger. The cold water for the air/cold water heat exchanger also can be supplied from a cold water tap. The heater is disposed after the air/cold water heat exchanger and before the pressurized air enters the plenum of the fluidized bed. Flexible tubing is provided to carry cooled water from the water chiller to the air/cold water heat exchanger and relatively warmed water from the air/cold water heat exchanger to the water chiller. Each of the free ends of the tubing, the water chiller, and the air/cold water heat exchanger, is provided with matching male or female connectors to enable the tubing to be selectively connected and disconnected between the water chiller and the air/water heat exchanger.

In accordance with the present invention, a controller is provided in the form of a programmable EPROM to control the operation of the heater, the fans of the air/air heat exchanger, and the flow of cooled water from the chiller to the air/cold water heat exchanger. A solenoid valve regulates whether the water from the chiller is permitted to enter the air/cold water heat exchanger, and this valve is operated by the controller.

In accordance with the present invention, a pair of temperature sensors is disposed in the mass of beads to monitor the temperature of the beads and provide this temperature information to the controller. A temperature sensor is disposed to measure the temperature of the pressurized air exiting the outlet of the blower. The controller is programmed to use the temperature information from the temperature sensors and the operating characteristics of the heater, air/air heat exchanger, fans, air/water heat exchanger, and water chiller to control the operation of the heater, the fans, and the water chiller for optimum efficiency in maintaining a desired temperature of the patient support surface under the extant temperature conditions in the environment of the fluidized bed. The controller is programmed desirably with software that places a first priority on attaining the bead temperature selected by the operator as quickly as possible. The controller is desirably programmed so that once the selected bead temperature has been attained, priority is then placed on maintaining the attained bead temperature with the minimum expenditure of electrical power. The controller is desirably further programmed so that once the selected bead temperature has been attained, priority is then placed on maintaining the attained bead temperature with the minimum introduction of heat into the environment of the fluidized bed.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. A consistent numbering scheme is maintained throughout the drawings.

Figure 1:
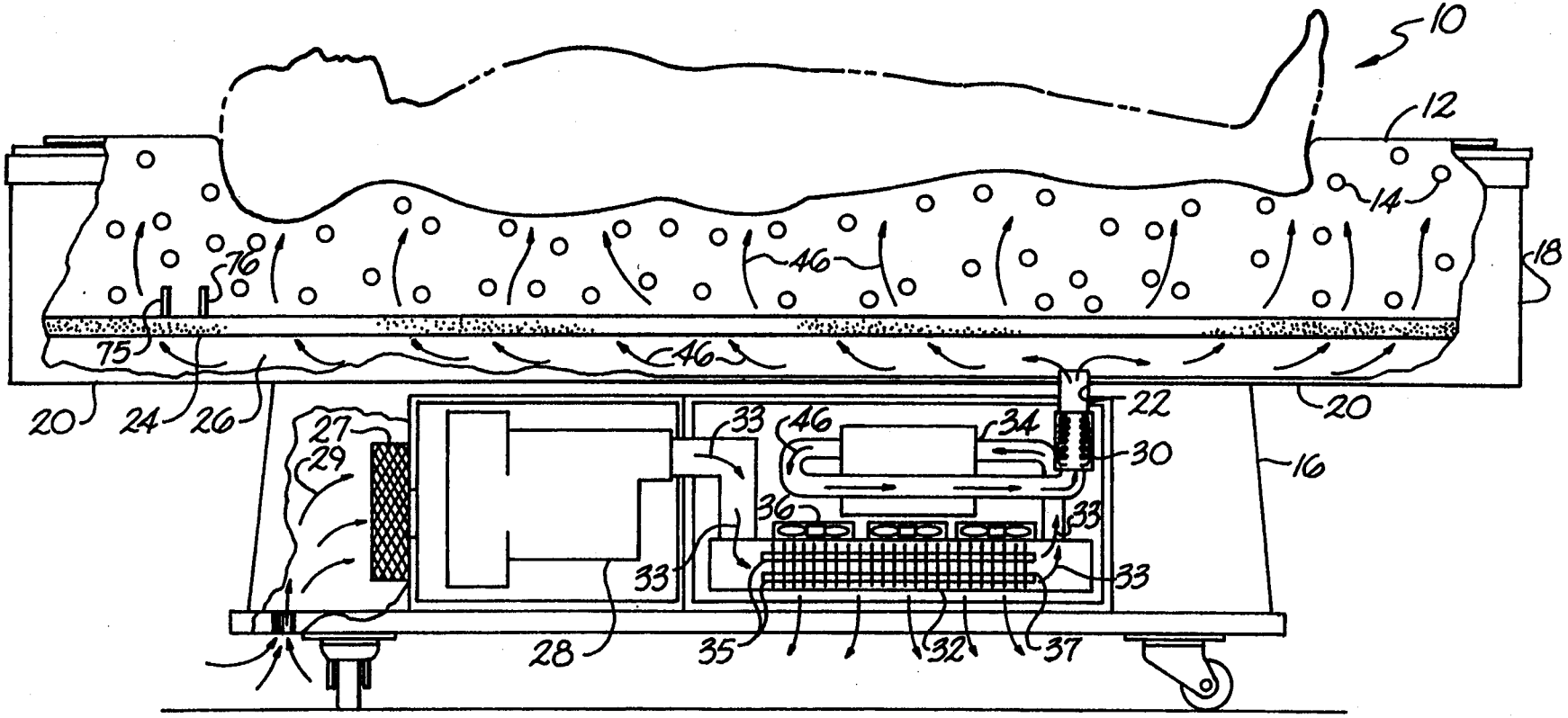
FIG. 1 is a schematic representation of a side plan view with portions cut away of a preferred embodiment of the bed component of the present invention.
Figure 2:
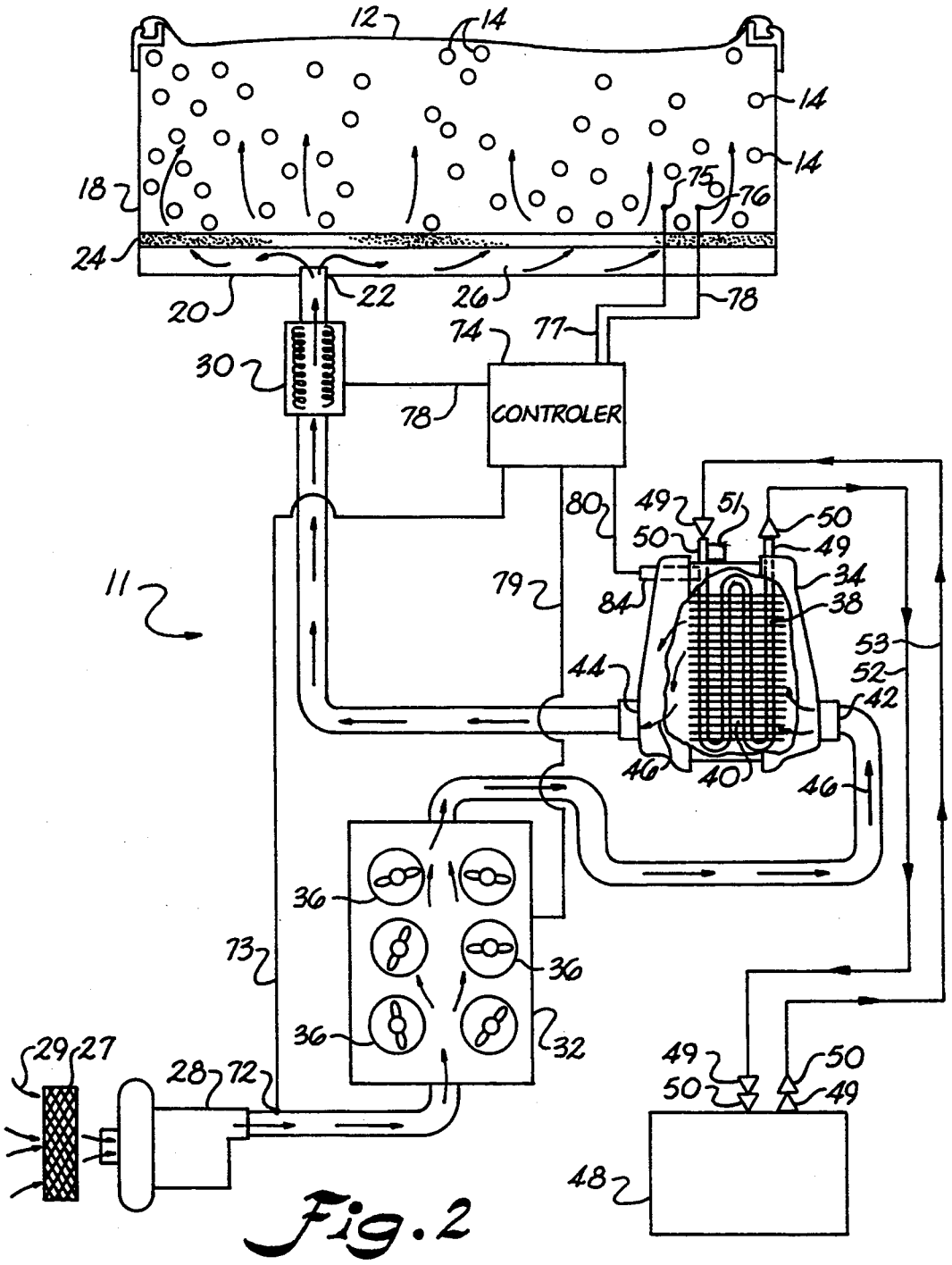
FIG. 2 is a schematic representation of a preferred embodiment of the present invention.

In accordance with the present invention, which is indicated generally in FIG. 1 by the numeral 10 and in FIG. 2 by the numeral 11, a fluidized patient support system is provided and includes a patient support surface formed of a filter sheet 12 disposed to cover a fluidizable granular material such as glass microspheres 14, also referred to as beads 14. In FIGS. 1 and 2, the beads are schematically represented by the oversize circles designated by the numeral 14. Typically, the beads are made of soda lime glass and have diameters ranging from between 50 microns and 150 microns. The beads provide a large thermal inertia so that temperature variations within the mass of beads occur rather slowly. For example, in a typical depth of 25 cm of beads, it takes between 30 and 45 minutes to reduce the temperature of the mass of beads by 1° C.

The fluidized patient support system provides a fluidized bed for the patient and includes a frame 16 which carries means for containing the mass of granular fluidizable material. As shown schematically in FIGS. 1 and 2, the containing means includes a tank 18 for holding the beads forming the mass of fluidizable granular material. The tank has a bottom wall 20 and an opening 22 defined through bottom wall 20. The beads are supported above the bottom wall of the tank by a diffusion board 24 configured and disposed in the tank to form an air distribution plenum 26 near the bottom wall of the tank. An air blower 28 is disposed in an enclosure disposed beneath the tank to provide pressurized air that enters plenum 26 through opening 22 and diffuses through diffusion board 24 to fluidize the beads 14. As shown in FIGS. 1 and 2, ambient air indicated by arrow 29 enters blower 28 via an air filter 27.

In accordance with the present invention, a means is provided for regulating the temperature of the fluidizable granular material. The temperature regulating means desirably includes a means for heating the air used to fluidize the mass of granular material, at least two temperature sensors, a programmable controller, and means for cooling the air that fluidizes the fluidizable granular material. The cooling means and the heating means desirably are disposed in the path of pressurized air after it exits the blower and before the pressurized air fluidizes the beads. As embodied herein and shown schematically in FIGS. 1 and 2 for example, the heating means includes an electrical resistance heater 30. As embodied herein and shown schematically in FIGS. 1 and 2 for example, the cooling means includes an air/air heat exchanger 32, an air/water heat exchanger 34, and at least one fan 36 disposed to force air through the air/air heat exchanger 32.

As shown in FIGS. 1 and 2, air/air heat exchanger 32 is configured and disposed to intercept the path of pressurized air leaving blower 28 on the way to air/water heat exchanger 34. As schematically shown in FIG. 1, air/air heat exchanger 32 desirably, is configured as a fin-and-tube heat exchanger with the pressurized air (indicated by arrows 33) routed through the tubes 35 of air/air heat exchanger 32. As shown in FIGS. 1 and 2, air/air heat exchanger 32 is provided with at least one electrically powered mini-cooling fan 36 and desirably is configured with a plurality of fans 36. Depending upon the type of electrical power that is available, a suitable embodiment of cooling fan 36 is provided by a 220 volt 50/60 Hz mini-cooling fan. Six cooling fans 36 are illustrated in FIG. 2, but eight fans are desirable. As schematically shown in FIG. 1, each fan 36 is configured and disposed to ventilate the fins 37 of air/air heat exchanger 32.

As schematically shown in FIGS. 1 and 2 for example, air/air heat exchanger 32 is desirably disposed immediately downstream of blower 28. The disposition of the air/air heat exchanger 32 immediately following the blower 28 in the path of the pressurized air used to fluidize the beads is important to maximize the cooling efficiency. This is because an air/air heat exchanger (without the fans operating) does not use externally applied energy to transfer the heat. The transfer of heat in the air/air heat exchanger is powered by the temperature difference between the input and output of the exchanger. The greater the temperature gradient between the air coming into the air/air heat exchanger and the ambient air, the more efficient is the air/air heat exchanger. Since a typical blower suitable for this application, increases the temperature of the ambient air by around 21° C., the outlet of the blower is the location along the path of the pressurized air where the temperature gradient is the greatest. Thus, to provide the most efficient heat transfer performance, the air/air heat exchanger is located immediately following the blower.

Air/water heat exchanger 34 is configured and disposed desirably to intercept the path of pressurized air leaving air/air heat exchanger 32 on the way to opening 22 through bottom wall 20 of tank 18. As shown schematically in FIGS. 1 and 2, in accordance with the direction of flow of pressurized air from blower 28 to beads 14, air/water heat exchanger 34 is disposed downstream of air/air heat exchanger 32 and upstream of heater 30. As schematically shown in FIG. 2, air/water heat exchanger 34 desirably is formed of a plenum chamber 40 with an inlet 42 and an outlet 44. The fluidizing air is indicated by arrows 46 as such air enters plenum 40 via inlet 42 and exits plenum 40 via outlet 44. As schematically shown in FIG. 2, disposed within plenum 40 is another fin-and-tube heat exchanger schematically represented by a zig-zag length of tubing 38 that travels through a plurality of fins 39 disposed within plenum chamber 40° Tubing 38 desirably is formed of heat conducting material, and chilled water (desirably about 15 degrees C.) is carried within tubing 38. As the fluidizing air (schematically indicated by arrows 46) moves through plenum 40 and contacts the tubing 38 and heat-conducting fins 39 attached thereto, heat is removed from the fluidizing air (indicated by arrows 46) and transferred to the chilled water (not shown) inside tubing 38.

Figure 3:
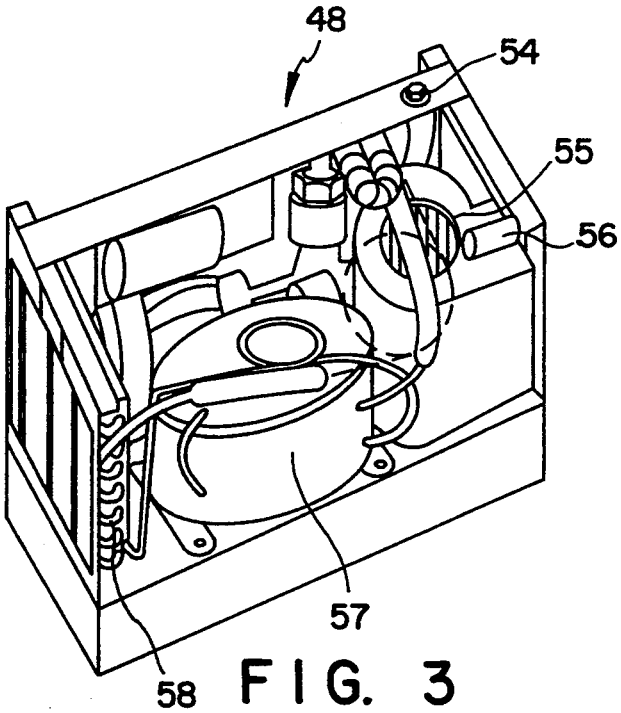
FIG. 3 is an elevated perspective view of components of a preferred embodiment of the present invention.
Figure 4:
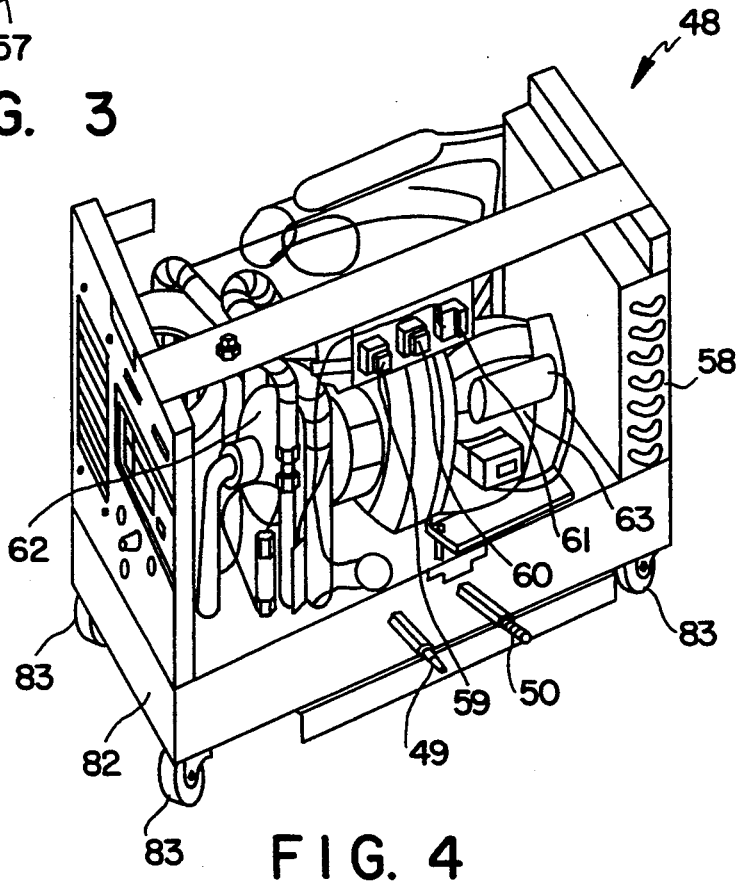
FIG. 4 is an elevated perspective view of components of a preferred embodiment of the present invention.
Figure 5A:
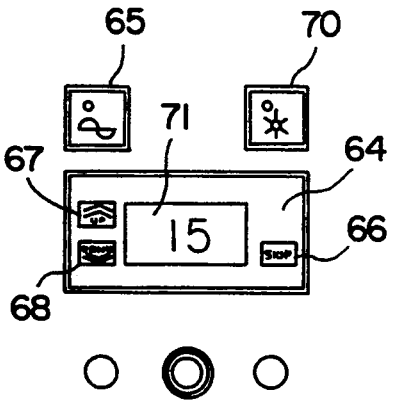
FIG. 5*a* is an expanded plan view of components shown in FIG. 5.
Figure 5:
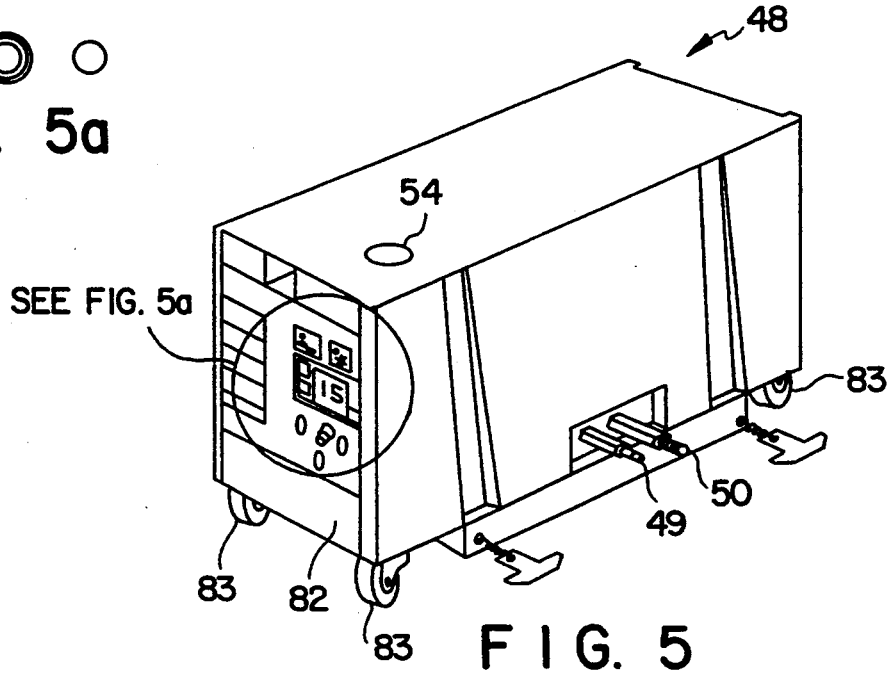
FIG. 5 is an elevated perspective view of components of a preferred embodiment of the present invention.

As shown in FIGS. 2–5 for example, the cooling means desirably includes a water cooling unit generally designated by the numeral 48, which desirably is configured for portability independent of the frame 16 and tank 18 of the fluidized patient support system. Water cooling unit 48, which also is referred to as water chiller 48 or chiller 48, is configured to be selectively remotely disposable from air/water heat exchanger 34. As schematically shown in FIGS. 2, 4 and 5 for example, water cooling unit 48 is provided with a male connector 49 and a female connector 50. As schematically shown in FIG. 2, a similar male connector 49 and female connector 50 are provided as external fittings on opposite ends of tubing 38 of air/water heat exchanger 34.

Figure 6:
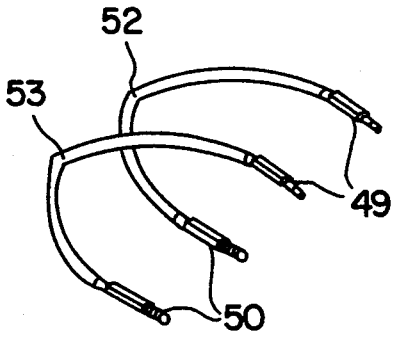
FIG. 6 is an elevated perspective view of components of a preferred embodiment of the present invention.

As shown in FIGS. 2 and 6 for example, a first conduit 52 in the form of a flexible hose is configured for carrying cooled water from the cooling unit 48 to the tubing 38 of air/water heat exchanger 34. First conduit 52 has one end provided with a male connector 49 that enables first conduit to be selectively connectable and disconnectable to chiller 48. The opposite end of first conduit 52 has been provided with a female connector 50 that enables first conduit 52 to be selectively connectable and disconnectable to one end of the tubing 38 of air/water heat exchanger 34.

As shown in FIGS. 2 and 6, a second conduit 53 in the form of a second length of flexible hose is configured for carrying relatively warmed water from air/water heat exchanger 34 to chiller 48. Second conduit 53 has one end provided with a male connector 49 that enables second conduit 53 to be selectively connectible and disconnectable to chiller 48. The opposite end of second conduit 53 has been provided with a female connector 50 that enables second conduit 53 to be selectively connectable and disconnectable to one end of the tubing 38 of air/water heat exchanger 34. As schematically shown in FIG. 2, the male and female connectors on chiller 48 and air/Water heat exchanger 34 are arranged so that it is impossible for the operator to connect first and second conduits 52, 53 in a manner that reverses the intended direction of the flow of chilled water pumped from chiller 48 to heat exchanger 34.

As shown in FIG. 3, chiller 48 includes a water leveling cap 54, a fan 55, a fan capacitor 56, a compressor 57, and a condenser 58. As shown in FIG. 4, chiller 48 includes a first transformer 59, a second transformer 60, an anti-icing thermostat 61, a tank 62 for holding water, and a water pump 63 to pump the cooled water to air/water heat exchanger 34. As shown schematically in FIG. 2, a water pressure reducer 51 also is desirably provided at the air/water heat exchanger 34 to reduce the pressure of the cooling water entering the air/water heat exchanger 34. This reduces the risk of water leaks that could introduce unwanted humidity into the fluidizing air, and enables the operator to use cold water from the tap as an alternative to the water chiller.

The chiller 48 has a water/refrigerant heat exchanger that is composed of two coaxial tubes (not shown), one for the water to be cooled and one for the refrigerant gas such as freon. Thermostat 61 prevents the water from freezing and digital thermometer/thermostat 64 (FIG. 5*a*) regulates and indicates the temperature of the water at the outlet of water chiller 48. Desirably, the water temperature control should be adjusted so that the temperature of the water exiting the chiller is 15° C. Any lower temperature would result in a greater likelihood of condensation problems inside air/water heat exchanger 34.

As shown in FIG. 5*a*, a switch 70 is provided to turn on the compressor 57, and a switch 65 is provided to turn on pump 63 and indicates when the pump is operative by an illuminated indicator changing color from green to red. A switch (not shown) activates the temperature display 71 which indicates the actual water temperature exiting chiller 48. The desired temperature is controlled by simultaneously depressing the set button 66 and either the up key 67 to increase the temperature setting or the down key 68 to decrease the temperature setting.

After the cooled water circulates through tubing 38 disposed in the path of the fluidizing air, the relatively warmed water is returned to water reservoir 62 in the water chiller disposed remotely from the fluidized bed. Freon-carrying refrigerating coils are disposed external to the water reservoir 62 and carry liquid freon which absorbs heat from the water through the walls of the coils. The cooled water from this reservoir can then pumped back to be recirculated through the water tubing 38 forming the auxiliary air/water heat exchanger 34 in the fluidized bed.

As schematically shown in FIG. 2 for example, the temperature regulating means further includes a first temperature sensor 72, which is provided by a temperature probe that is carried by the patient support system. First temperature probe 72 is configured and disposed to intercept the path of pressurized air leaving blower 28. First temperature probe 72 provides electrical signals via a cable 73 to a controller 74. These electrical signals indicate the temperature of the pressurized air leaving the blower and are a function of the temperature of the ambient air provided to the inlet of the blower. This is because passage of the ambient air through the blower typically can raise the temperature of the pressurized air about 21° C. higher than the temperature of the ambient air entering the blower.

As shown in FIGS. 1 and 2 for example, the temperature regulating means also includes at least a second temperature sensor, which is provided by a second temperature probe 75 that is configured and disposed within the tank in the midst of the mass of granular material. Second temperature probe 75 provides electrical signals indicating the temperature of the mass of granular material near the diffuser board 24 at a location deep inside tank 18. Desirably, two temperature probes are provided near the diffuser board in order to reduce the possibility that a single temperature probe will be located in a region of anomalous temperature conditions. Thus, at least a third temperature sensor is provided in the vicinity of the second temperature probe 75 in the form of a third temperature probe 76 which is configured and disposed to provide electrical signals indicating the temperature of the mass of fluidizable material. The second and third temperature probes 75, 76 provide temperature information via cables 77, 78, respectively, to controller 74. Controller 74 is programmed to compare the temperature readings received from probes 75, 76. Unless there is less than 4° C. discrepancy between the temperature information provided by second probe 75 and third probe 76, controller 74 is programmed to alert the operator of a problem with the temperature probes. As schematically shown in FIG. 1, temperature probes 75, 76 desirably are placed near the head end of the tank 18 and in the vicinity of the longitudinal centerline of the tank 18.

Typically, the temperature of the beads at the bottom of the tank is about 2° C. more than the temperature of the beads 14 at the patient support surface formed against filter sheet 12. Moreover, because of the fluidization of the beads 14, the temperature of the patient support surface against filter sheet 12 typically varies within about 3° C.

In further accordance with the present invention, the temperature regulating means further includes a programmable controller. As embodied herein and schematically shown in FIG. 2 for example, the controller 74 desirably is provided by an EPROM that is programmable to receive temperature-indicative signals from each of the temperature sensors 72, 75, 76. Controller 74 is programmed to use the temperature information to control the heater 30 via a cable 78, each of the fans via a cable 79, and a solenoid valve 84 via a cable 80 in a manner that makes efficient use of the temperature gradient between the ambient air and an operator-selected, desired temperature of the beads 14 forming the patient support surface. Solenoid valve 84 regulates whether water from the water chiller 48 is permitted to circulate in tubing 38 of air/water heat exchanger 34. When solenoid valve 84 is open, then water from chiller 48 is permitted to circulate through tubing 38. When solenoid valve 84 is closed by controller 74, then water from chiller 48 is not permitted to circulate through tubing 38 and instead is internally circulated within chiller 48 via an internal by-pass circuit (not shown). The water pump 63 of chiller 48 operates continuously in this configuration. However, in an alternative configuration, the pressure build-up in the second conduit 53 could produce a back-pressure in the chiller 48 that would trigger deactivation of the water pump 63.

The controller is programmed with software that takes account of the thermal effects of blower 28, air/air heat exchanger 32 with and without fans 36 operating, air/water heat exchanger 34 with water chiller 48 operating, and heater 30. Each of these components either adds or subtracts heat from the air used to fluidize the beads. Blower 28 and heater 30 add heat and thus ultimately increase the temperature of the beads 14. Heater 30 has the capability of increasing the temperature of the fluidizing air by as much as about 20 degrees C. Air/air heat exchanger 32 removes heat, thereby reducing the temperature of the air used to fluidize the beads. Air/air heat exchanger 32 with operational fans 36 further reduces the temperature by removing additional heat from the air used to fluidize the beads. Air/water heat exchanger 34 with cooling water circulating in tubing 38 removes heat and thus further reduces the temperature of the air provided to fluidize the beads. Without cooling water circulating in tubing 38, air/water heat exchanger 34 will only absorb heat from the fluidizing air until the temperature of exchanger 34 equals the temperature of the fluidizing air.

Controller 74 has an EPROM that is programmed with a logic that has three goals. The first and highest priority goal is to change the temperature of the beads to the requested temperature as selected by the operator of the fluidized patient support system. The second priority of the controller's software program is to minimize the amount of electrical power that is used in maintaining the bead temperature selected by the operator once this bead temperature has been attained. The final priority of the controller's software is to maintain the desired bead temperature with the least possible increase in temperature in the ambient atmosphere of the fluidized patient support system. Controller 74 desirably is programmed to use the temperature desired by the operator, the ambient temperature as determined by the temperature information provided by first temperature probe 72, the temperature of the beads as determined by one or both of second and third temperature probes 75, 76, and the heat transfer and energy consumption characteristics of the aforementioned heat transfer components 30, 32, 34, 36 to govern in accordance with the above-mentioned three priorities, operation of heater 30, operation of fans 36, and operation of valve 84 to regulate circulation of water from chiller 48 through tubing 38. Of course other goals could be selected for governing the software logic. For example, the priorities could be changed.

Controller 74 is programmed to monitor and account for the effect on the temperature of the fluidizing air attributable to each of the components of the system.

For example, since the effect of the blower is to increase the ambient temperature by about 20° to 21° C., the first temperature sensor 72 indirectly measures the temperature of the ambient atmosphere surrounding the fluidizable patient support system.

Air/air heat exchanger 32 operates without any expenditure of power by the system. With due regard for the amount of fluidizing air typically passing through air/air heat exchanger 32 and the heat transfer characteristics of air/air exchanger 32, the effect of air/air exchanger 32 without the fans 36 operating is to lower the temperature of the fluidizing air by about 4° to 5° C. While the auxiliary fans 36 require the system to use electrical power for their operation, they do not consume a lot of energy and their operation nearly doubles the heat transfer performance of the air/air heat exchanger alone. By operating the auxiliary fans 36, the air/air heat exchanger has the capability of lowering the temperature of the fluidizing air by as much as about an additional 7 to 9 degrees C. Thus, with the fans 36 operating, air/air heat exchanger 32 has the capability of lowering the temperature of the fluidizing air by a total of about 11 to 14 degrees C.

The water chiller 48 is the least energy efficient component used by the system to effect cooling of the fluidizing air. For example, the water chiller requires more electricity for operation than is required to operate the fans of the air/air heat exchanger. Thus, the controller's software is programmed to restrict use of water chiller 48 only as a last resort and only to supplement the cooling performance of the other cooling components of the system. With due regard for the amount of fluidizing air typically passing through air/water heat exchanger 34 and the heat transfer characteristics of heat exchanger 34, water chiller 48 has the capability of reducing the temperature of the fluidizing air by as much as about an additional 9 degrees C. Similarly, with due regard for the amount of fluidizing air typically passing through heater 30 and the heat transfer characteristics of heater 30, the effect of heater 30 is to increase the temperature of the fluidizing air by about 20° C.

The controller 74 is programmed to determine the current temperature conditions from the temperature probes 72, 75, 76 and compare the measured temperature of the beads with the desired bead temperature requested by the operator. The controller is programmed to avoid operating the cooling means if the ambient temperature is low and a high beads temperature is requested. The controller is programmed to avoid operating the heater if the heat coming from the blower is sufficient to attain and maintain the requested bead temperature. The controller is programmed so that after the controller determines whether heating or cooling is required and the magnitude of the difference in temperature that must be achieved, controller 74 selects the appropriate heating or cooling component(s) to be operated in order to achieve the desired result in accordance with the programmed priorities. Controller 74 is programmed using conventional methods of sampling the temperature readings from the probes and using iterative calculation algorithms to monitor and regulate the temperature changes and the desirability of beginning, continuing, or ceasing operation of selected heat transfer components at the system's disposal.

As an example, Appendix 1 demonstrates how controller 74 would select the status of the various heat transfer components when programmed with certain assumptions about the heat transfer effect of the various components. Each SELECTION AND STATUS CONTROL GRID is presented for a particular temperature (in degrees C.) requested by the operator [Requstd T] for different conditions of ambient temperature [AMB T] (in degrees C.) in the environment of the fluidized bed and different temperatures (in degrees C.) of the microspheres [T Microsp]. The microsphere temperature is the temperature measured by temperature sensor 75, 76 near diffuser board 24. The ambient temperature is the temperature measured by temperature sensor 72 corrected by a constant amount of 21° C. which is the increase in ambient temperature attributable to the pressurization of the fluidizing air by blower 28 [T b]. The effect on the temperature of the fluidizing air of the air/air heat exchanger without fans 36 operating is assumed to be a constant 5° C. [T r] reduction in temperature. The additional reduction in temperature of the fluidizing air by operating fans 36 is assumed to be a constant 7° C. [T v]. The operating status of the fans (F) of the air/air exchanger 32 is indicated beneath the column labeled "F". When the fans are operating, the symbol "V1" is disposed beneath the column headed "F." When the fans are not operated, the symbol beneath column F is "V0." The effect of operating cooling unit 48 is assumed to be a constant 9° C. reduction in the temperature of the fluidizing air [T w]. The operating status of the air/water exchanger 34 with the cooling water circulating from cooling unit 48 is indicated beneath the column labeled "W". When the water chiller 48 is operating, the symbol "W1" is disposed beneath the column headed "W." When the water chiller is not operated, the symbol beneath column W is "W0." When the heater 30 is operating, the symbol "Hi" is disposed beneath the column headed "H." When the heater is not operated, the symbol beneath column H is "H0."

If the passive (no fans operating) air/air heat exchanger 32 cannot reduce the temperature sufficiently to attain the temperature requested by the operator, controller 74 is programmed to operate the fans 36, which do not consume a lot of energy and nearly double the heat reducing performance of the air/air heat exchanger. Referring to the appropriate SELECTION AND STATUS CONTROL GRID VIII, if the temperature of the microspheres is 36 degrees C. and the operator requests a bead temperature of 35° C. while the ambient temperature around the fluidized bed is about 22° C. and the heat transfer operating characteristics of the components are the CONSTANTS stated in the GRID, then a desirable embodiment of the controller's software will program the controller 74 to determine that the air/air heat exchanger with the fans 36 operating (as indicated in the chart by the symbol V1 in the F column) will be sufficient to attain the requested beads temperature in a reasonable time, maintain the requested temperature with minimum power expenditure, and minimize the heat introduced into the immediate environment of the fluidized bed. The software will program controller 74 to determine that operation of the water-chiller is not necessary and controller 74 will not operate chiller 48.

However, the software programs the controller 74 to operate in a manner so that if the air/air heat exchanger 32 and the fans 36 have not sufficiently decreased the temperature, then controller 74 operates the water chiller 48, but only in an auxiliary capacity to complete the cooling action. Thus, the software programs controller 74 to operate in a manner so that if under the same conditions noted above, the operator requests a beads temperature of 28° C. (See GRID I), then controller 74 will operate both the fans 36 of the air/air heat exchanger 32 and operate the water chiller 48 to attain the desired temperature. Thereafter, controller 74 will operate water chiller 48 intermittently to maintain the 28° C. beads temperature selected by the operator.

Controller 74 is desirably programmed so that it only operates the less efficient chiller 48 as a last resort, because the more the temperature must be decreased, the longer the water chiller must be operated, but the result will be a significant energy consumption. If controller 74 can employ the more efficient cooling devices so that the same temperature performance can be achieved with less use of the water chiller, the energy consumption will be decreased and the introduction of calories into the patient's room will be minimized.

In accordance with the present invention, the water-chiller can be removed from the immediate environment of the fluidized bed. The water chiller may be removed from the fluidized bed during transportation or repairs. Moreover, the water chiller may be removed from the fluidized bed so that the chiller can be disposed remotely from and outside of the patient's room (in a bathroom, hall, etc). Especially in the case of a small room and/or a room with poor ventilation, the portability of the water-chiller enables it to be placed outside the patient's room where the water chiller will not increase the ambient temperature in the patient's room.

As shown in FIGS. 4 and 5, the removability of the water chiller is made possible by its portable separate housing 82 with wheels 83, by its ability to use first and second conduits 52, 53 of different lengths and with ends having male and female connectors 49, 50 for easy connection and disconnection, and by its use of ordinary water as the coolant so that the first and second conduits carrying the coolant can be disconnected when not in use. Such disconnection would be impossible if freon gas, which is undesirable in a patient environment, were circulating in cooling coils 38 inside the fluidized bed.

An air/air heat exchanger that has the capability of cooling the air sufficiently to cool the beads for comfortable operation in a hot temperature environment, such as the summer months, would be much too large to be housed conveniently in the fluidized bed. Thus, one embodiment of the present invention provides an auxiliary air/water heat exchanging unit 34 for cooling the beads 14 during operation of the bed in hot weather environments.

In the present invention, an air/cold water heat exchanger was chosen over a conventional refrigeration unit using freon for several reasons. First, the patient should not be exposed to freon gas. Passing the fluidizing air through an air/water heat exchanger in the present invention instead of an air/freon heat exchanger, eliminates the risk of accidental freon leakage that would mix freon with fluidization air. The water chiller of the present invention keeps the freon remote from the fluidizing air while nontoxic ordinary water flows through the air/water heat exchanger housed in the fluidized bed.

Moreover, during winter months in some environments, the temperature of the beads does not get high enough to warrant using the cooling capacity of the air/water cooling system, and the air/water heat exchanger is therefore too powerful to be used to cool the beads in such cases. Accordingly, in winter months, the air/air heat exchanger is adequate and more efficient for cooling the beads. In winter months, the chiller of the air/water system can be disconnected. Since the chiller is only needed in hot temperature environments, another reason for preferring the air/water unit to an air/freon unit, pertains to the desirability of being able to disconnect the chiller when not in use. Such disconnection would be impossible if freon gas, which is undesirable in a patient environment, were circulating in cooling coils inside the fluidized bed.

A third reason pertains to the inability to transport freon gas in flexible tubing over long distances between the chiller and the fluidized bed. If freon heat transfers were made, the water-chiller could not be installed very far from the fluidized bed simply by extending the length of first and second conduits 52, 53.

A fourth reason pertains to the inconvenience of having to remove condensate from the fluidizing air supply system. Any moisture that is condensed out of the air during the cooling process would be present in the system and would need to be removed by some other means or it would accumulate. Any accumulated water from condensate would possibly cause a health problem. Unlike the cooling coils of freon refrigeration equipment, the cooling water in the air/cold water exchanger is not cold enough to cause condensation to form on the cooling tubes 38 of the

APPENDIX 1

SELECTION AND STATUS CONTROL GRID I

Reqstd T° = 28 CONSTANTS T°b 21 T°r −5 T°v −7 T°w −9

| T°Microsp = | 26 | | | 27 | | | 28 | | | 29 | | | 30 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | V0 | — | — | V0 | — | — | V1 | — | — | V1 | W1 | — |
| 19 | — | — | H1 | V0 | W0 | — | V0 | W0 | — | V1 | W1 | — | V1 | W1 | — |
| 20 | — | — | H1 | V0 | W0 | — | V0 | W0 | — | V1 | W1 | — | V1 | W1 | — |
| 21 | — | — | H1 | V0 | W0 | — | V0 | W0 | — | V1 | W1 | — | V1 | W1 | — |
| 22 | — | — | H1 | V0 | W0 | — | V0 | W0 | — | V1 | W1 | — | V1 | W1 | — |
| 23 | — | — | H1 | V0 | W0 | — | V0 | W0 | — | V1 | W1 | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | HI | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |

APPENDIX 1-continued

| | | | | | | | | | | | | | | | |
|---|---|---|---|---|---|---|---|---|---|---|---|---|---|---|---|
| 35 | — | — | H1 | V0 | W0 | — | V0 | W0 | — | V1 | W1 | — | V1 | W1 | — |

SELECTION AND STATUS CONTROL GRID II

Reqstd T° = 29 CONSTANTS T°b 21 T°r −5 T°v −7 T°w −9

| T°Microsp = | 27 | | | 28 | | | 29 | | | 30 | | | 31 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | V0 | — | — | V0 | — | — | V1 | — | — | V1 | W1 | — |
| 19 | — | — | H1 | V0 | — | — | V0 | — | — | V1 | — | — | V1 | W1 | — |
| 20 | — | — | H1 | V0 | W0 | — | V0 | W0 | — | V1 | W1 | — | V1 | W1 | — |
| 21 | — | — | H1 | V0 | W0 | — | V0 | W0 | — | V1 | W1 | — | V1 | W1 | — |
| 22 | — | — | H1 | V0 | W0 | — | V0 | W0 | — | V1 | W1 | — | V1 | W1 | — |
| 23 | — | — | H1 | V0 | W0 | — | V0 | W0 | — | V1 | W1 | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID III

Reqstd T° = 30 CONSTANTS T°b 21 T°r −5 T°v −7 T°w −9

| T°Microsp = | 28 | | | 29 | | | 30 | | | 31 | | | 32 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | V0 | — | — | V0 | — | — | V1 | — | — | V1 | W1 | — |
| 19 | — | — | H1 | V0 | — | — | V0 | — | — | V1 | — | — | V1 | W1 | — |
| 20 | — | — | H1 | V0 | — | — | V0 | — | — | V1 | — | — | V1 | W1 | — |
| 21 | — | — | H1 | V0 | W0 | — | V0 | W0 | — | V1 | W1 | — | V1 | W1 | — |
| 22 | — | — | H1 | V0 | W0 | — | V0 | W0 | — | V1 | W1 | — | V1 | W1 | — |
| 23 | — | — | H1 | V0 | W0 | — | V0 | W0 | — | V1 | W1 | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | HI | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID IV

Reqstd T° = 31 CONSTANTS T°b 21 T°r −5 T°v −7 T°w −9

| T°Microsp = | 29 | | | 30 | | | 31 | | | 32 | | | 33 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | V0 | — | — | V0 | — | — | V1 | — | — | V1 | W1 | — |
| 19 | — | — | H1 | V0 | — | — | V0 | — | — | V1 | — | — | V1 | W1 | — |
| 20 | — | — | H1 | V0 | — | — | V0 | — | — | V1 | — | — | V1 | W1 | — |
| 21 | — | — | H1 | V0 | — | — | V0 | — | — | V1 | — | — | V1 | W1 | — |
| 22 | — | — | HI | V0 | W0 | — | V0 | W0 | — | V1 | W1 | — | V1 | W1 | — |
| 23 | — | — | H1 | V0 | W0 | — | V0 | W0 | — | V1 | W1 | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | HI | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID V

Reqstd T° = 32 CONSTANTS T°b 21 T°r −5 T°v −7 T°w −9

| T°Microsp = | 30 | | | 31 | | | 32 | | | 33 | | | 34 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |

APPENDIX 1-continued

| | | | | | | | | | | | | | | | |
|---|---|---|---|---|---|---|---|---|---|---|---|---|---|---|---|
| 18 | — | — | H1 | V0 | — | — | V0 | — | — | V1 | — | — | V1 | W1 | — |
| 19 | — | — | H1 | V0 | — | — | V0 | — | — | V1 | — | — | V1 | W1 | — |
| 20 | — | — | H1 | V0 | — | — | V0 | — | — | V1 | — | — | V1 | W1 | — |
| 21 | — | — | H1 | V0 | — | — | V0 | — | — | V1 | — | — | V1 | W1 | — |
| 22 | — | — | H1 | V0 | — | — | V0 | — | — | V1 | — | — | V1 | W1 | — |
| 23 | — | — | H1 | V0 | W0 | — | V0 | W0 | — | V1 | W1 | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID VI

Reqstd T° = 33 CONSTANTS T°b 21 T°r −5 T°v −7 T°w −9

| T°Microsp = | 31 | | | 32 | | | 33 | | | 34 | | | 35 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | V0 | — | — | V0 | — | — | V1 | — | — | V1 | W1 | — |
| 19 | — | — | H1 | V0 | — | — | V0 | — | — | V1 | — | — | V1 | W1 | — |
| 20 | — | — | H1 | V0 | — | — | V0 | — | — | V1 | — | — | V1 | W1 | — |
| 21 | — | — | H1 | V0 | — | — | V0 | — | — | V1 | — | — | V1 | W1 | — |
| 22 | — | — | H1 | V0 | — | — | V0 | — | — | V1 | — | — | V1 | W1 | — |
| 23 | — | — | H1 | V0 | — | — | V0 | — | — | V1 | — | — | V1 | W1 | — |
| 24 | — | — | H1 | V0 | W0 | — | V0 | W0 | — | V1 | W1 | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID VII

Reqstd T° = 34 CONSTANTS T°b 21 T°r −5 T°v −7 T°w −9

| T°Microsp = | 32 | | | 33 | | | 34 | | | 35 | | | 36 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | V0 | — | H0 | V1 | — | — | V1 | W1 | — |
| 19 | — | — | H1 | V0 | — | — | V0 | — | — | V1 | — | — | V1 | W1 | — |
| 20 | — | — | H1 | V0 | — | — | V0 | — | — | V1 | — | — | V1 | W1 | — |
| 21 | — | — | H1 | V0 | — | — | V0 | — | — | V1 | — | — | V1 | W1 | — |
| 22 | — | — | H1 | V0 | — | — | V0 | — | — | V1 | — | — | V1 | W1 | — |
| 23 | — | — | H1 | V0 | — | — | V0 | — | — | V1 | — | — | V1 | W1 | — |
| 24 | — | — | H1 | V0 | — | — | V0 | — | — | V1 | — | — | V1 | W1 | — |
| 25 | — | — | H1 | V0 | W0 | — | V0 | W0 | — | V1 | W1 | — | V1 | W1 | — |
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID VIII

Reqstd T° = 35 CONSTANTS T°b 21 T°r −5 T°v −7 T°w −9

| T°Microsp = | 33 | | | 34 | | | 35 | | | 36 | | | 37 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | — | V1 | W1 | — |
| 19 | — | — | H1 | — | — | H1 | V0 | — | H0 | V1 | — | — | V1 | W1 | — |
| 20 | — | — | H1 | V0 | — | — | V0 | — | — | V1 | — | — | V1 | W1 | — |
| 21 | — | — | H1 | V0 | — | — | V0 | — | — | V1 | — | — | V1 | W1 | — |
| 22 | — | — | H1 | V0 | — | — | V0 | — | — | V1 | — | — | V1 | W1 | — |
| 23 | — | — | H1 | V0 | — | — | V0 | — | — | V1 | — | — | V1 | W1 | — |
| 24 | — | — | H1 | V0 | — | — | V0 | — | — | V1 | — | — | V1 | W1 | — |
| 25 | — | — | H1 | V0 | — | — | V0 | — | — | V1 | — | — | V1 | W1 | — |

APPENDIX 1-continued

| | | | | | | | | | | | | | | | |
|---|---|---|---|---|---|---|---|---|---|---|---|---|---|---|---|
| 26 | — | — | H1 | V0 | W0 | — | V0 | W0 | — | V1 | W1 | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID IX

Reqstd T° = 36 CONSTANTS T°b 21 T°r −5 T°v −7 T°w −9

| T°Microsp = | 34 | | | 35 | | | 36 | | | 37 | | | 38 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | H0 | V1 | W1 | — |
| 19 | — | — | H1 | — | — | H1 | — | — | H0 | — | — | — | V1 | W1 | — |
| 20 | — | — | H1 | — | — | H1 | V0 | — | H0 | V1 | — | — | V1 | W1 | — |
| 21 | — | — | H1 | V0 | — | — | V0 | — | — | V1 | — | — | V1 | W1 | — |
| 22 | — | — | H1 | V0 | — | — | V0 | — | — | V1 | — | — | V1 | W1 | — |
| 23 | — | — | H1 | V0 | — | — | V0 | — | — | V1 | — | — | V1 | W1 | — |
| 24 | — | — | H1 | V0 | — | — | V0 | — | — | V1 | — | — | V1 | W1 | — |
| 25 | — | — | H1 | V0 | — | — | V0 | — | — | V1 | — | — | V1 | W1 | — |
| 26 | — | — | H1 | V0 | — | — | V0 | — | — | V1 | — | — | V1 | W1 | — |
| 27 | — | — | H1 | V0 | W0 | — | V0 | W0 | — | V1 | W1 | — | V1 | W1 | — |
| 28 | — | — | H1 | V0 | W0 | — | V0 | W0 | — | V1 | W1 | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID X

Reqstd T° = 37 CONSTANTS T°b 21 T°r −5 T°v −7 T°w −9

| T°Microsp = | 35 | | | 36 | | | 37 | | | 38 | | | 39 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | H0 | V1 | W1 | — |
| 19 | — | — | H1 | — | — | H1 | — | — | H0 | — | — | H0 | V1 | W1 | — |
| 20 | — | — | H1 | — | — | H1 | — | — | H0 | — | — | — | V1 | W1 | — |
| 21 | — | — | H1 | — | — | H1 | V0 | — | H0 | V1 | — | — | V1 | W1 | — |
| 22 | — | — | H1 | V0 | — | — | V0 | — | — | V1 | — | — | V1 | W1 | — |
| 23 | — | — | H1 | V0 | — | — | V0 | — | — | V1 | — | — | V1 | W1 | — |
| 24 | — | — | H1 | V0 | — | — | V0 | — | — | V1 | — | — | V1 | W1 | — |
| 25 | — | — | H1 | V0 | — | — | V0 | — | — | V1 | — | — | V1 | W1 | — |
| 26 | — | — | H1 | V0 | — | — | V0 | — | — | V1 | — | — | V1 | W1 | — |
| 27 | — | — | H1 | V0 | — | — | V0 | — | — | V1 | — | — | V1 | W1 | — |
| 28 | — | — | H1 | V0 | W0 | — | V0 | W0 | — | V1 | W1 | — | V1 | W1 | — |
| 29 | — | — | HI | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID XI

Reqstd T° = 38 CONSTANTS T°b 21 T°r −5 T°v −7 T°w −9

| T°Microsp = | 36 | | | 37 | | | 38 | | | 39 | | | 40 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | H0 | V1 | W1 | — |
| 19 | — | — | H1 | — | — | H1 | — | — | H0 | — | — | H0 | V1 | W1 | — |
| 20 | — | — | H1 | — | — | H1 | — | — | H0 | — | — | H0 | V1 | W1 | — |
| 21 | — | — | H1 | — | — | H1 | — | — | H0 | — | — | — | V1 | W1 | — |
| 22 | — | — | H1 | — | — | H1 | V0 | — | H0 | V1 | — | — | V1 | W1 | — |
| 23 | — | — | H1 | V0 | — | — | V0 | — | — | V1 | — | — | V1 | W1 | — |
| 24 | — | — | H1 | V0 | — | — | V0 | — | — | V1 | — | — | V1 | W1 | — |
| 25 | — | — | H1 | V0 | — | — | V0 | — | — | V1 | — | — | V1 | W1 | — |
| 26 | — | — | H1 | V0 | — | — | V0 | — | — | V1 | — | — | V1 | W1 | — |
| 27 | — | — | H1 | V0 | — | — | V0 | — | — | V1 | — | — | V1 | W1 | — |
| 28 | — | — | H1 | V0 | — | — | V0 | — | — | V1 | — | — | V1 | W1 | — |
| 29 | — | — | H1 | V0 | W0 | — | V0 | W0 | — | V1 | W1 | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |

APPENDIX 1-continued

| | | | | | | | | | | | | | | | |
|---|---|---|---|---|---|---|---|---|---|---|---|---|---|---|---|
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID XII

Reqstd T° = 39 CONSTANTS T°b 21 T°r −5 T°v −7 T°w −9

| T°Microsp = | 37 | | | 38 | | | 39 | | | 40 | | | 41 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | H0 | V1 | W1 | — |
| 19 | — | — | H1 | — | — | H1 | — | — | H0 | — | — | H0 | V1 | W1 | — |
| 20 | — | — | H1 | — | — | H1 | — | — | H0 | — | — | H0 | V1 | W1 | — |
| 21 | — | — | H1 | — | — | H1 | — | — | H0 | — | — | H0 | V1 | W1 | — |
| 22 | — | — | H1 | — | — | H1 | — | — | H0 | — | — | — | V1 | W1 | — |
| 23 | — | — | H1 | — | — | H1 | V0 | — | H0 | V1 | — | — | V1 | W1 | — |
| 24 | — | — | H1 | V0 | — | — | V0 | — | — | V1 | — | — | V1 | W1 | — |
| 25 | — | — | H1 | V0 | — | — | V0 | — | — | V1 | — | — | V1 | W1 | — |
| 26 | — | — | H1 | V0 | — | — | V0 | — | — | V1 | — | — | V1 | W1 | — |
| 27 | — | — | H1 | V0 | — | — | V0 | — | — | V1 | — | — | V1 | W1 | — |
| 28 | — | — | HI | V0 | — | — | V0 | — | — | V1 | — | — | V1 | W1 | — |
| 29 | — | — | H1 | V0 | — | — | V0 | — | — | V1 | — | — | V1 | W1 | — |
| 30 | — | — | H1 | V0 | W0 | — | V0 | W0 | — | V1 | W1 | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

SELECTION AND STATUS CONTROL GRID XIII

Reqstd T° = 40 CONSTANTS T°b 21 T°r −5 T°v −7 T°w −9

| T°Microsp = | 38 | | | 39 | | | 40 | | | 41 | | | 42 | | |
|---|---|---|---|---|---|---|---|---|---|---|---|---|---|---|---|
| STATUS | F | W | H | F | W | H | F | W | H | F | W | H | F | W | H |
| AMB T° | | | | | | | | | | | | | | | |
| 18 | — | — | H1 | — | — | H1 | — | — | H0 | — | — | H0 | V1 | W1 | — |
| 19 | — | — | H1 | — | — | H1 | — | — | H0 | — | — | H0 | V1 | W1 | — |
| 20 | — | — | H1 | — | — | H1 | — | — | H0 | — | — | H0 | V1 | W1 | — |
| 21 | — | — | H1 | — | — | H1 | — | — | H0 | — | — | H0 | V1 | W1 | — |
| 22 | — | — | H1 | — | — | H1 | — | — | H0 | — | — | H0 | V1 | W1 | — |
| 23 | — | — | H1 | — | — | H1 | — | — | H0 | — | — | — | V1 | W1 | — |
| 24 | — | — | H1 | — | — | H1 | V0 | — | H0 | V1 | — | — | V1 | W1 | — |
| 25 | — | — | H1 | V0 | — | — | V0 | — | — | V1 | — | — | V1 | W1 | — |
| 26 | — | — | H1 | V0 | — | — | V0 | — | — | V1 | — | — | V1 | W1 | — |
| 27 | — | — | H1 | V0 | — | — | V0 | — | — | V1 | — | — | V1 | W1 | — |
| 28 | — | — | H1 | V0 | — | — | V0 | — | — | V1 | — | — | V1 | W1 | — |
| 29 | — | — | H1 | V0 | — | — | V0 | — | — | V1 | — | — | V1 | W1 | — |
| 30 | — | — | H1 | V0 | — | — | V0 | — | — | V1 | — | — | V1 | W1 | — |
| 31 | — | — | H1 | V0 | W0 | — | V0 | W0 | — | V1 | W1 | — | V1 | W1 | — |
| 32 | — | — | H1 | V0 | W0 | — | V0 | W0 | — | V1 | W1 | — | V1 | W1 | — |
| 33 | — | — | H1 | V0 | W0 | — | V0 | W0 | — | V1 | W1 | — | V1 | W1 | — |
| 34 | — | — | H1 | V0 | W0 | — | V0 | W0 | — | V1 | W1 | — | V1 | W1 | — |
| 35 | — | — | H1 | V0 | W0 | — | V0 | W0 | — | V1 | W1 | — | V1 | W1 | — |

air/water heat exchanger. This eliminates any need to provide for removal of water condensate from the system.

What is claimed is:

1. A fluidized patient support system having a patient support surface formed of fluidizable granular material, said system comprising:

a frame;

means for containing a mass of fluidizable granular material, said containing means being carried by said frame;

a blower configured and disposed for providing pressurized air to fluidize the patient support surface; and a means for regulating the temperature of the fluidizable granular material, said temperature regulating means including a means for cooling the pressurized air provided by said blower to fluidize the patient support surface, said pressurized air cooling means using cooled water to cool the pressurized air for fluidizing the fluidizable granular material.

2. An apparatus as in claim 1, wherein:

said pressurized air cooling means includes an air/water heat exchanger configured and disposed to intercept the path of pressurized air used to fluidize the patient support surface.

3. An apparatus as in claim 2, further comprising:

a pressure reducer configured and disposed for reducing the pressure of cooled water before circulating through said air/water heat exchanger.

4. An apparatus as in claim 2, wherein:

said pressurized air cooling means includes a water cooling unit, said water cooling unit being configured to be selectively remotely disposable from said air/water heat exchanger.

5. An apparatus as in claim 4, wherein said temperature regulating means includes a programmable controller configured and connected to regulate the flow of water from said water cooling unit.

6. A fluidized patient support system having a patient support surface formed of fluidizable granular material, said system comprising:

a frame;

means for containing a mass of fluidizable granular material, said containing means being carried by said frame;

a blower configured and disposed for providing pressurized air to fluidize the patient support surface; and a means for regulating the temperature of the fluidizable granular material, said temperature regulating means including a means for cooling the pressurized air provided by said blower to fluidize the patient support surface, said pressurized air cooling means using cooled water to cool the pressurized air for fluidizing the fluidizable granular material, wherein said pressurized air cooling means includes an air/air heat exchanger configured and disposed to intercept the path of pressurized air leaving said blower on the way to fluidize the mass of granular material.

7. An apparatus as in claim 6, wherein said air/air heat exchanger is disposed immediately downstream of said blower.

8. An apparatus as in claim 6, wherein said pressurized air cooling means includes at least one fan configured and disposed to ventilate said air/air heat exchanger.

9. An apparatus as in claim 8, wherein said temperature regulating means includes a programmable controller configured and connected to control operation of said at least one fan.

10. A fluidized patient support system having a patient support surface formed of fluidizable granular material, said system comprising:

a frame;

means for containing a mass of fluidizable granular material, said containing means being carried by said frame;

a blower configured and disposed for providing pressurized air to fluidize the patient support surface; and a means for regulating the temperature of the fluidizable granular material, said temperature regulating means including a means for cooling the pressurized air provided by said blower to fluidize the patient support surface, said pressurized air cooling means using cooled water to cool the pressurized air for fluidizing the fluidizable granular material;

said pressurized air cooling means including an air/-water heat exchanger configured and disposed to intercept the path of pressurized air used to fluidize the patient support surface and, wherein said pressurized air cooling means includes a water cooling unit configured for supplying cooled water to said air/water heat exchanger, said water cooling unit being further configured for portability independently of the fluidized patient support system.

11. An apparatus as in claim 10, further comprising:

a solenoid valve disposed for regulating the flow of cooled water circulating through said air/water heat exchanger from said water cooling unit.

12. An apparatus as in claim 10, wherein said pressurized air cooling means includes:

a first conduit configured for carrying cooled water from said water cooling unit to said air/water heat exchanger, said first conduit having one end selectively connectable to said water cooling unit and a second end selectively connectable to said air/water heat exchanger; and a second conduit configured for carrying relatively warmed water from said air/water heat exchanger to said water cooling unit, said second conduit having one end selectively connectable to said water cooling unit and a second end selectively connectable to said air/water heat exchanger.

13. Fluidized patient support system having a patient support surface formed of fluidizable granular material, said system comprising:

a frame;

means for containing a mass of fluidizable granular material, said containing means being carried by said frame;

a blower configured and disposed for providing pressurized air to fluidize the patient support surface;

a means for regulating the temperature of the fluidizable granular material, said temperature regulating means including a means for cooling the pressurized air provided by said blower to fluidize the patient support surface said pressurized air cooling means using cooled water to cool the pressurized air for fluidizing the fluidizable granular material;

said pressurized air cooling means including an air/-water heat exchanger configured and disposed to intercept the path of pressurized air used to fluidize the patient support surface;

said pressurized air cooling means including a water cooling unit, said water cooling unit being configured to be selectively remotely disposable from said air/water heat exchanger;

said temperature regulating means including a programmable controller configured and connected to regulate the flow of water from said water cooling unit, wherein:

said temperature regulating means includes at least a first temperature sensor configured and disposed to sense the temperature of a portion of the fluidizable granular material and to provide signals indicating the temperature of said portion of the fluidizable granular material; and said programmable controller being connected to receive temperature-indicative signals from said first temperature sensor, said programmable controller being configured to use the temperature-indicative signals received by said controller from said first temperature sensor to regulate the flow of water from said water cooling unit.

14. A fluidized patient support system having a patient support surface formed of fluidizable granular material, said system comprising:

a frame;

means for containing a mass of fluidizable granular material, said containing means being carried by said frame;

a blower configured and disposed for providing pressurized air to fluidize the patient support surface;

a means for regulating the temperature of the fluidizable granular material, said temperature regulating means including a means for cooling the pressurized air provided by said blower to fluidize the patient support surface, said pressurized air cooling means using cooled water to cool the pressurized air for fluidizing the fluidizable granular material;

said pressurized air cooling means including an air/-water heat exchanger configured and disposed to intercept the path of pressurized air used to fluidize the patient support surface, wherein said pressurized air cooling means includes an air/air heat exchanger configured and disposed upstream of said air/water heat exchanger and immediately downstream of said blower to intercept the path of pressurized air leaving said blower before being intercepted by said air/water heat exchanger.

15. An apparatus as in claim 14, wherein said temperature regulating means includes a means for heating the air used to fluidize the mass of granular material.

16. An apparatus as in claim 15, wherein said heating means is configured and disposed to intercept the path of pressurized air leaving said air/water heat exchanger on the way to fluidize the mass of granular material.

17. An apparatus as in claim 15, wherein said heating means includes an electrical resistance heater.

18. A fluidized patient support system having a patient support surface formed of fluidizable granular material, said system comprising:

a frame;

a tank carried by said frame and having a bottom wall and an opening defined through said bottom wall;

a diffusion board configured and disposed in said tank to form an air distribution plenum near said bottom wall of said tank;

a mass of fluidizable granular material disposed in said tank above said diffusion board;

an air blower configured and disposed for providing pressurized air to fluidize said mass of fluidizable granular material;

at least a first temperature sensor configured and disposed to sense the temperature of pressurized air leaving said blower and to provide signal is indicating the temperature of the pressurized air leaving said blower;

at least a second temperature sensor configured and disposed to measure the temperature of said fluidizable granular material at a location inside said tank and to provide signals indicating the temperature of said fluidizable granular material;

an air/air heat exchanger configured and disposed immediately downstream of said blower to intercept the path of pressurized air leaving said blower on the way to said opening through said bottom wall of said tank;

at least one fan configured and disposed to ventilate said air/air heat exchanger;

an air/water heat exchanger configured and disposed to intercept the path of pressurized air leaving said air/air heat exchanger on the way to said opening through said bottom wall of said tank;

a water cooling unit, said water cooling unit being configured for portability independently of the fluidized patient support system;

a first conduit configured for carrying cooled water from said water cooling unit to said air/water heat exchanger, said first conduit having one end selectively connectable to said water cooling unit and a second end selectively connectable to said air/water heat exchanger;

a solenoid valve disposed for regulating the flow of cooled water circulating through said air/water heat exchanger from said water cooling unit;

a pressure reducer disposed for reducing the pressure of cooled water before circulating through said air/water heat exchanger;

a second conduit configured for carrying relatively warmed water from said air/water heat exchanger to said cooling unit, said second conduit having one end selectively connectable to said water cooling unit and a second end selectively connectable to said air/water heat exchanger;

a heater disposed between said air/water heat exchanger and said opening through said bottom wall of said tank to intercept the path of pressurized air leaving said air/water heat exchanger on the way to said opening through said bottom wall of said tank; and a programmable controller connected to receive temperature-indicative signals from each of said first and second temperature sensors, said programmable controller being configured and connected to, control each of said heater, said at least one fan, and said solenoid valve according to the temperature-indicative signals received by said controller from each of said first and second temperature sensors.

* * * * *